United States Patent [19]

Boast

[11] 4,109,107

[45] Aug. 22, 1978

[54] METHOD AND APPARATUS FOR FREQUENCY COMPENSATION OF ELECTRO-ACOUSTICAL TRANSDUCER AND ITS ENVIRONMENT

[75] Inventor: Warren Benefield Boast, Ames, Iowa

[73] Assignee: Iowa State University Research Foundation, Inc., Ames, Iowa

[21] Appl. No.: 812,786

[22] Filed: Jul. 5, 1977

[51] Int. Cl.[2] ..... H04R 3/04

[52] U.S. Cl. ..... 179/1 D

[58] Field of Search ..... 179/1 D

[56] References Cited

U.S. PATENT DOCUMENTS

| | | | |
|---|---|---|---|
| 2,802,054 | 8/1957 | Corney | 179/1 D |
| 3,148,537 | 9/1964 | Berwin et al. | 333/28 R |

*Primary Examiner*—George G. Stellar

*Attorney, Agent, or Firm*—Emrich, Root, O'Keeffe & Lee

[57] ABSTRACT

The anechoic audio response of a speaker is measured over a frequency range; and the composite anechoic audio response is separated into three distinct characteristic curves, namely (1) the mechanical response characteristic of the speaker, (2) the cone-air energy transfer characteristic, and (3) the cone break-up characteristic. Compensation is made for each of these phenomena by means of separate networks having frequency characteristic curves which are complementary to, and thereby compensate for, the frequency characteristic associated with the phenomena. The networks independently process the signal to achieve a substantially uniform audio output over the desired frequency range. Compensation may also be made in a similar fashion for the acoustics of the room in which the speaker is used. Frequency compensation of a microphone is made for the same phenomena by means of similar compensation networks to achieve a substantially uniform microphone voltage over the desired frequency range.

17 Claims, 17 Drawing Figures

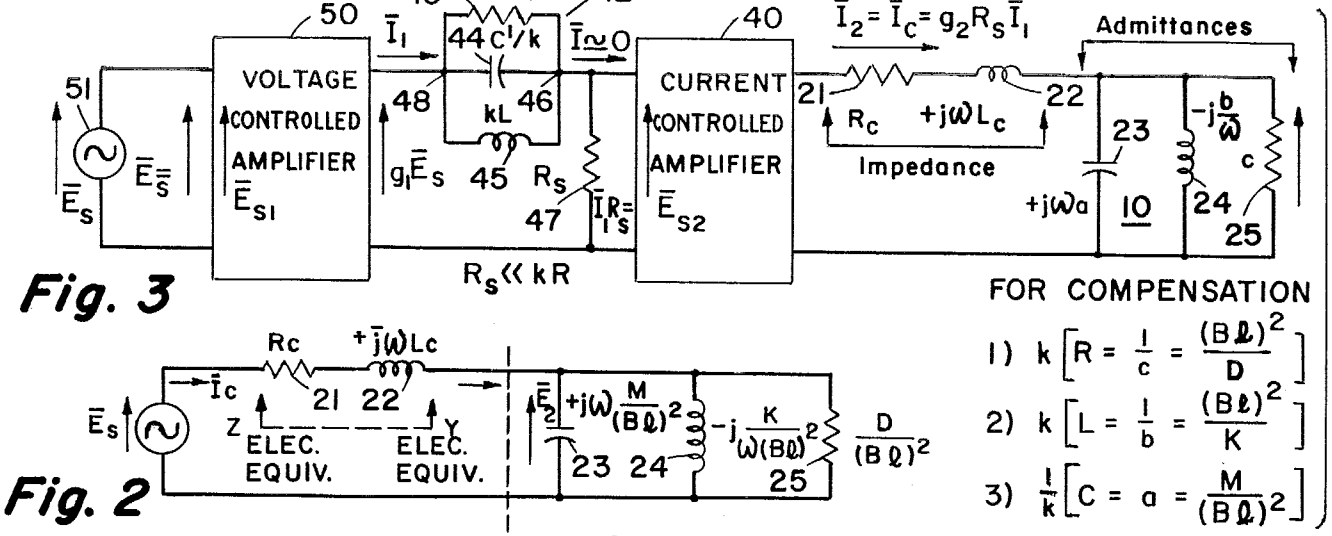
Fig. 3
Fig. 2
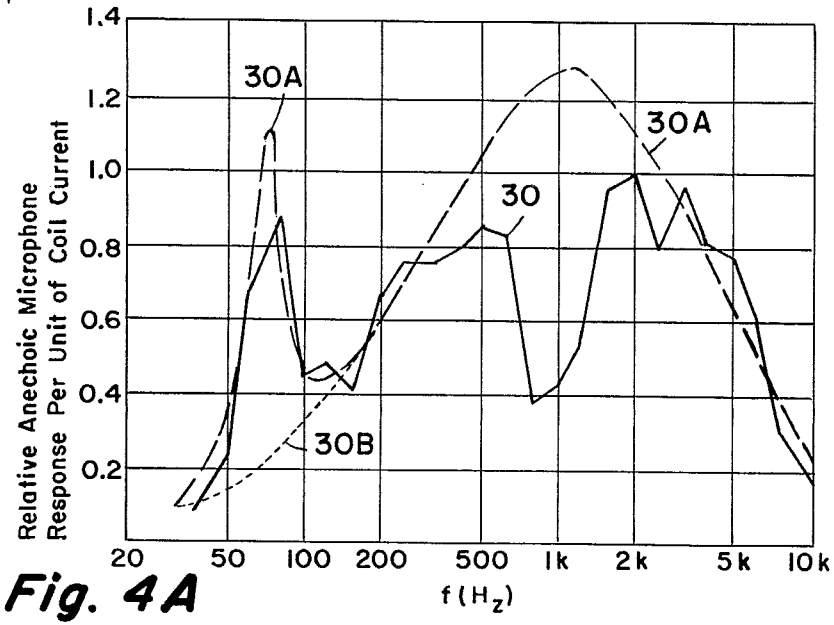
Fig. 4A
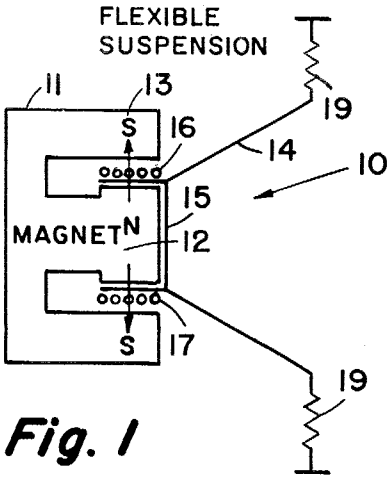
Fig. 1
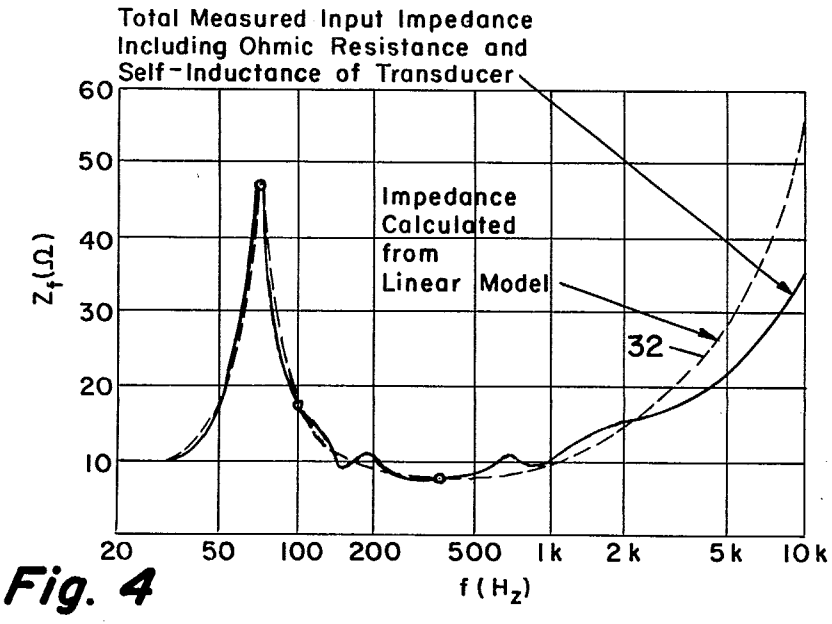
Fig. 4

METHOD AND APPARATUS FOR FREQUENCY COMPENSATION OF ELECTRO-ACOUSTICAL TRANSDUCER AND ITS ENVIRONMENT

BACKGROUND AND SUMMARY

The present invention relates, in general, to a broad class of transducers which are herein referred to as "electroacoustical" transducers. These are transducers such as (a) speakers which are driven by an electrical signal and produce an acoustic output or sound, or (b) microphones which are activated by sound pressure signals and produce an electrical output.

Transducers of this type are known to have an inherent dependency upon, or sensitivity to, the frequency of the signal which drives the transducer. In my U.S. Pat. No. 3,988,541, issued Oct. 26, 1976, a method and apparatus is disclosed for compensating for the frequency dependency of the mechanical response parameters of the transducer. As defined there, the mechanical response parameters include the mass, M, of the cone and transducer coil, the elasticity or spring parameter, K, in the suspension system for the cone and coil, and the loss, D, including the dissipation in the cone and the work performed in vibrating the air adjacent the cone to generate the acoustic output. Thus, the three parameters of mass, spring parameter and loss are referred to as the "mechanical response parameters" of the transducer.

Briefly, the referenced patent provides a current controlled power amplifier to drive the speaker; and the input signal of this current amplifier is modified to have a frequency characteristic which is the complement of the corresponding frequency characteristic of the mechanical response parameters of the transducer. In this context, the term "complement" is intended to mean that the input signal to the power amplifier is made large where the mechanical response is small and vice verse. In other words, for a given primary input signal of constant magnitude over the desired frequency range, where a relatively large output signal is produced by the mechanical parameters, the signal processing network acts to attenuate the primary input signal. For those frequencies at which the output of the transducer is relatively small, then the signal processing network reinforces or strengthens the driving signal such that the compensation network modifies the primary input electrical signal in such a manner that the resulting signal fed to the speaker has a frequency characteristic which is the complement of the corresponding frequency characteristic of the mechanical response parameters of the speaker. The result is that the velocity of the diaphragm or cone is substantially uniform over the frequency range of interest.

I have found that in addition to the frequency dependency caused by the mechanical response parameters of a speaker, there are other phenomena which are frequency dependent, and therefore cause a frequency dependency in the overall acoustic response of the transducer, at least over a portion of the range. Further, I have discovered that these phenomena can be isolated and independently compensated.

The principal frequency dependent characteristics of a transducer not including the environment in which it is located comprise: (1) the effect of the mechanical response parameters of the transducer, as discussed above; (2) the effect of the cone-air power transfer characteristic; (3) the effect of cone break-up. The latter effect is not always present, but if it is detected, compensation can be made according to the present invention. Further, the present invention permits compensation for the effects of room acoustics.

To compensate for the first three effects, the speaker is placed in an anechoic chamber, and its audio response is measured over a desired frequency range using a calibrated microphone to measure sound pressure levels. The composite anechoic audio response is separated into three distinct characteristic curves, namely (1) the mechanical response characteristic of the speaker; (2) the cone-air power transfer characteristic; and (3) the cone break-up characteristic. Cone break-up does not occur in all speakers, but it is a phenomenon in which all portions of the speaker diaphragm do not vibrate in unison. In other words, standing waves may exist usually along the radial direction of the cone, and since some of the harmonics are out of phase with others and with the fundamental, there is a power loss in the acoustic output.

Compensation is made for each of these phenomena by means of a network having a frequency characteristic curve complementary to the frequency characteristic of the associated phenomena. When the compensation networks are all connected in tandem, the system processes the incoming signal to achieve substantially uniform audio response over the desired frequeny range. By uniform audio response it is meant that the sound pressure level measured in an anechoic chamber is substantially uniform- i.e., within a few decibels, as distinguished from the variations of orders of magnitude without compensation. After compensation is made for these three phenomena, the compensated speaker may be placed in a room and the response measured at a given point in the room. Still another compensation network may be added to process the input signal to the speaker in a fashion similar to the compensations made for the mechanical response characteristics of the speaker and the cone-air transfer characteristic. In some rooms the sound-transmission characteristics may exhibit such a large number of reflections and reverberations that this compensation may not be worthwhile, but the principles of the present invention will enable compensation to be made for most cases.

Other features and advantages of the present invention will be apparent to persons skilled in the art from the following detailed description of an illustrative embodiment accompanied by the attached drawing wherein identical reference numerals will refer to like elements in the various views.

THE DRAWING

FIG. 1 is a schematic drawing illustrating the mechanical response parameters of a speaker;

FIG. 2 is an electrical diagram showing the admittance parameters of an equivalent circuit for the mechanical response parameters of the coil of FIG. 1 and including the equivalent series circuit of impedance for the speaker coil;

FIG. 3 is a circuit schematic diagram, partly in functional block form, of a system which includes compensation for the frequency-dependent mechanical response parameters of the speaker of FIG. 1;

FIG. 4 is a graph of the input impedance of a speaker as a function of frequency;

FIG. 4A is a graph of the acoustic response of a speaker in an anechoic chamber driven by a constant coil current over a frequency range of interest;

Figure 16:
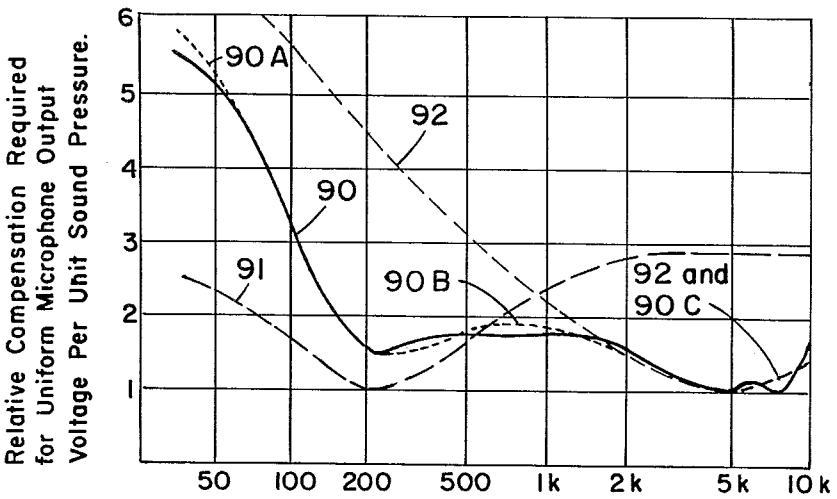
Figure 15:
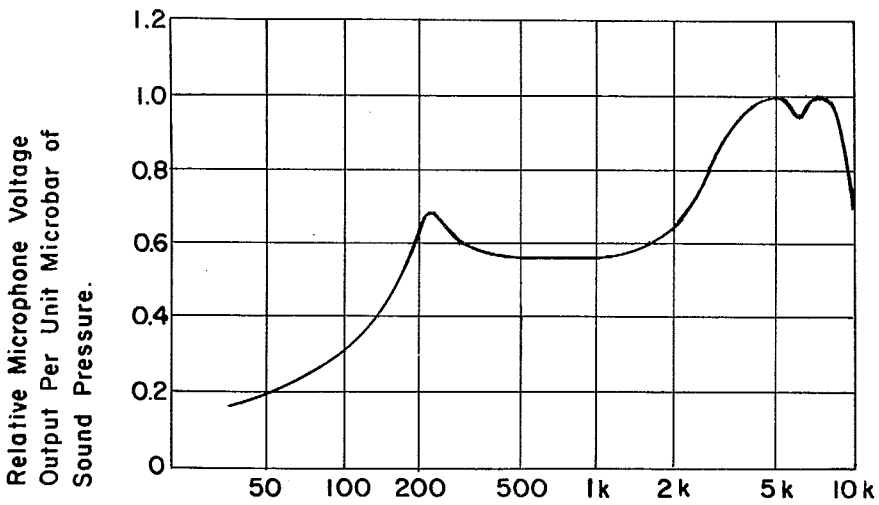

FIG. 15 is a graph of the output voltage of a microphone driven by a constant sound pressure over a frequency range of interest; and FIG. 16 is a graph of the complementary frequency characteristic of FIG. 15 and graphs of the relative output signal for constant input signal for the various compensation networks required to equalize the overall response of the microphone whose characteristic is shown in FIG. 15.

DETAILED DESCRIPTION

Referring to FIG. 1, there is shown a diagrammatic view, in cross section, of an electrical speaker generally designated by reference numeral 10. The speaker includes a magnet 11 having a central leg 12 and an annular outer leg 13. The central leg, in the illustration, is polarized as a north pole, indicated by N; and the annular peripheral portion 13 is polarized as a south pole, indicated by S.

The speaker 10 also includes a diaphragm or cone 14 which is provided with a central portion 15 surrounding the distal portion of the central leg 12 and about which is wound a coil designated 16. The poles of the magnet 11 are separated, as illustrated, to define an annular air gap generally designated 17 in which the movable voice coil 16 is located.

As a current is passed through the coil 16, a force is exerted on the coil according to the well-known relationship $f_g = \mathrm{Bli}$ where, $f_g$ is the force on the coil, B is the flux density in the air gap, $l$ is the length of the coil, and $i$ is the current flowing through the coil.

The force $f_g$ of course, is a vector, and the direction of the force depends upon the polarity of the current, but in either case, it is parallel to the axis of the central leg 12 of the magnet.

The diaphragm 14 is mounted by conventional means comprising a flexible suspension system generally designated by reference numeral 19.

In FIG. 2, there is shown a composite equivalent circuit of the transducer including a resistor 21 in series with an inductor 22, followed by a parallel network including capacitor 23, inductor 24 and resistor 25. The capacitor 23, inductor 24 and resistor 25 are the electrical equivalents of the mechanical response parameters, as derived in my referenced U.S. patent 3,988,541. Briefly, the values shown in FIG. 2 for the capacitor 23, inductor 24 and resistor 25 are the admittance values where:

B is the flux density in the air gap, $l$ is the length of the coil, $i$ is the current through the coil, $\omega$ is the radian frequency, M is the mass of the combined speaker cone and voice coil, D is the frictional and power dissipation parameter of the system, including any losses in the moving coil suspension system itself, and more importantly, the power dissipation required to move the air in front of the cone which, in turn, causes the acoustical radiation from the system, and K is the spring action of the cone suspension.

The value of resistor 21, $R_c$, is the ohmic resistance in the voice coil, and the inductor 22, $L_c$, is the self-inductance of the voice coil.

Looking into the actual physical terminals of the transducer, an impedance vs. frequency curve as the solid line shown in FIG. 4 is obtained. This includes the effects of the ohmic resistance 21 and the self-inductance 22 of the coil. The ordinates of this curve are calculated from the magnitude of the voltage across the terminals of the voice coil divided by the magnitude of the resulting current flowing in the coil, each pair of voltage and current values being measured at a discrete frequency over the audio range. Employing the principles disclosed in the patent, for an acoustic suspension system wherein the cabinet is sealed and the spring elastance parameter $b$ is nearly constant over the frequency spectrum, the solid curve of FIG. 4 illustrates the impedance vs. frequency characteristic of an eight-inch, eight-ohm speaker with simple outer edge corrugated suspension. The cone resonance frequency is 72 Hz where the total input impedance is 48.4 ohms. This provides two independent data conditions for determination of the five parameters ($a$, $b$, and $c$, the mechanical response parameters and $R_c$ and $L_c$, the electrical parameters), as described in my patent. Further, from the graph, the mass of the cone system and the inductance of the coil are in series resonance at 372 Hz where the total input impedance is 8.4 ohms. This provides two more independent data conditions for determining the five parameters. A fifth independent data condition as chosen was the impedance at 100 Hz where the total input impedance $Z_t$ was 18.4 ohms.

By the method of iteration described in the patent, the linear model is determined. The calculated parameters shown below yield the dashed curve 32 of FIG. 4 which passes through the three frequencies of 72, 100 and 372 Hz.

PARAMETERS CALCULATED FROM MEASURED IMPEDANCE MEASUREMENTS OF FIG. 4

$a = 0.2194 \times 10^{-3}$ $b = 44.90$ $c = 0.02494$ $r_c = 8.4$ $L_c = 0.864 \times 10^{-3}$ (all in metric SI units)

The two electrical parameters of $R_c$ and $L_c$ are not linear, particularly in the higher range of frequencies. Such variation makes the measured value of the impedance smaller for the higher frequencies than the plot from the linear model, but such variation of $R_c$ and $L_c$ presents no problem to this invention because the current output of the power amplifier is controlled so as to provide the desired current $I_c$ so that $E_L = 1_c Z_m$ and hence the cone velocity is not influenced by the values of $R_c$ and $L_c$ whether they be constants or variable with frequency. $Z_m$ is $1/[c+j(a\omega - b/\omega)]$ and $E_L$ is the counter emf of the transducer.

If the only goal in designing the electrical speakers were to provide a cone velocity that was not frequency sensitive, a single signal-processing model of the mechanical parameters *a, b* and *c* could provide compensation for the frequency dependency of the mechanical response parameters of the transducer.

The input terminals of the transducer are fed by a current controlled amplifier 40 of FIG. 3 (or simply a current amplifier). The characteristics of the amplifier 40 are that it has a high input impedance and that its output current is a function of its input signal. The input of the current controlled amplifier 40 is fed from a compensation network or circuit generally designated 42 including a parallel combination of a resistor 43, a capacitor 44 and an inductor 45. The output terminal of the compensation network is the same as the input terminal of the current amplifier 40, and it is designated 46. A resistor $R_s$ and designated 47 is connected across the input terminals of the amplifier 40, and it has a value for complete compensation which is negligible compared with the minimum value of the impedance of network 42 or with the magnitude of the input impedance 40. The input terminal 48 of the network 42 is taken from the output of the voltage amplifier 50 which is energized by the signal source, schematically shown at 51. No impedance corresponding to the transducer impedances 21, 22 are necessary or desirable in the model network 42.

In order to compensate for the frequency dependency of the mechanical response parameters of the transducer, namely capacitor 23, inductor 24 and resistor 25, the amplifier 40 is a current amplifier which forces the required current into the coil irrespective of the values of the ohmic resistor 21 and the self-inductance of the coil 22. The current amplifier 40 is a linear amplifier over a predetermine amplitude and frequency range using current feedback to achieve a high output impedance. There are many designs of current amplifiers known in the art, and the techniques for designing current amplifiers to operate from either voltage or current input signals are also well known in the art.

The electrical network 42 is a scaled model (the factor "*k*" being the scaling factor of the mechanical response parameters of the transducer). That is, the dissipation of the transducer (including both friction and acoustical radiation represented by resistor 25) is represented by the resistor 43 of the compensation network 42. Similarly, the electrical equivalent of the mass of the transducer or capacitor 23 is represented by the capacitor 44 of the compensation network, and the electrical equivalent of the spring parameter 24 is represented by the inductor 45 of the compensation network.

Thus, the compensation network 42 forms a signal processing circuit which, together with the current amplifier 40 provides a coil current into the speaker which is controlled as a function of frequency to produce a velocity of the cone 14 which is frequency independent provided there is negligible limiting of the coil current by the resistor 47 (that is, the value of $R_s$ is small as compared with the minimum value of the impedance of the compensation network 42 and when compared with the input impedance of the current amplifier).

CONE-AIR TRANSFER CHARACTERISTIC

As indicated above, I have found that there are at least three other phenomena which influence the fidelity of an acoustical system in addition to the frequency dependency of the mechanical response parameters of the transducer. Further, I have discovered that each of these phenomena can be compensated independently of the others. This enables a designer to isolate or identify the effects of each phenomenon and separately compensate for it. The second phenomenon with which the present invention is concerned is the cone-air transfer characteristic. In other words, the efficiency with which mechanical power of the vibrating diaphragm is converted to acoustical power has a definite frequency characteristic.

In order to measure the effects on a speaker of the cone-air transfer characteristic for providing for compensation for it, the speaker is placed in an anechoic chamber and a calibrated microphone is also placed in the chamber for measuring the acoustic second pressure output of the speaker. In order to reduce the effect of reverberations or reflections in the chamber due to the presence of the microphone and the speaker, the preferred signal source for energizing the speaker is a recording containing RIAA pink-noise. Such a recording contains signals of bounded frequency spans, but the signals within each span have randomly varying frequency. By making characteristic measurements on the speaker in an anechoic chamber, using a pink-noise source signal, the effect of all reverberations is removed, and a norm or calibration is established for the speaker itself. Later, when the room reverberation effect is included and compensation is to be provided for this effect, the use of the same signal sources provides a definitive measure of the room reverberation effect when compared with the characteristic of the speaker alone.

In FIG. 4A, reference numeral 30 refers to a characteristic curve measured using the speaker identified in connection with the discussion of FIG. 4, and using a calibrated microphone in an anechoic environment. The speaker was driven with a pink-noise ⅓-octave series of signals from a commercially available recording produced by Bruel and Kjaer. The ordinate of curve 30 is an indication of millivolts of calibrated pickup microphone voltage at a fixed speaker-to-microphone spacing for a constant speaker coil current all as a function of frequency. The curve as plotted is a relative ordinate curve with unity for that frequency (2kHz) where the response is a maximum.

I have observed that the characteristic of FIG. 4A (curve 30), sometimes referred to as the anechoic acoustical response of a speaker is caused by three principal components. The first component is the effect of the resonance phenomena of the mechanical response parameters and is that component having major influence upon the shape of the frequency response for those frequencies near the mechanical resonance. A second component is the effect of the cone-air transfer characteristic jusst described which has influence upon the frequency response over the whole audio frequency spectrum. A third component, apparent in the anechoic acoustical response for the speaker (although not present in all speakers for the design frequency range), is that due to cone break-up which may have influence upon the frequency response over one or more localized frequency band regions. The response characteristic, curve 30 of FIG. 4A exhibits a major cone break-up phenomena extending below and above a center frequency of about 900 Hz.

Figure 5:
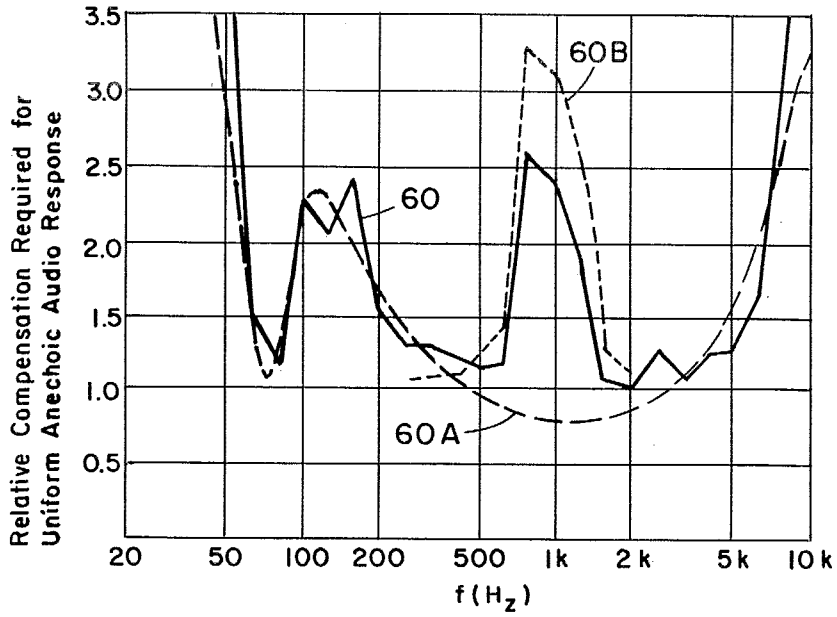
FIG. 5 is a graph of the complementary frequency characteristic for that of FIG. 4A which is required for uniform anechoic acoustic response for the speaker.

Turning now to FIG. 5, there is shown a graph 60 which is the reciprocal of the curve 30 of FIG. 4A. In other words, the curve 60 represents the overall compensation required for uniform anechoic acoustic response for measurements taken using a pink-noise signal source and also referred to unity compensation at 2 KHz (the frequency of minimum compensation).

In both FIG. 4A and in FIG. 5, dotted curves designated 30A and 60A represent an estimate of the relative response or compensation, respectively, that would result if one breakup did not occur. Such an estimate temporarily eliminates the need for considering cone break-up and its compensation, and it is useful in understanding the combination of the modfified compensation systems for the cone-air transfer characteristic acting together with the mechanical parameters.

To provide full-scale exact compensation for both the mechanical parameters and an actual cone-air transfer characteristic would impose the stringent requirement that such systems operate over a very wide amplitude range of output/input signals, and yet the overall product of the two compensations acting in tandem upon the primary input signal results in a relatively small signal change over the whole audio range. A practical procedure, according to a preferred embodiment, is to utilize the resistor $R_s$, 47 of FIG. 3 (repeated individually as FIG. 7), to limit the effect of compensation by increasing value of $R_s$ so that it is not negligible with respect to the impedance level of network 42. In addition, the value of the resistor 43 representing the dissipation parameter and the resonant frequency of either or both modified compensation systems may be adjusted so that the desired overall compensation can be achieved directly while employing reasonable signal levels throughout the compensation networks.

The overall audio response illustrated as curve 30A of FIG. 4A, neglecting any cone break-up, has the general form of a resonance phenomena in this upper frequency range from about 200 Hz to 10 kHz. This portion of the response illustrates the predominance of the cone-air transfer characteristic over the effects of the mechanical parameters whose change with frequency is less pronounced in the higher frequency range.

At lower frequencies (below 200 Hz) the overall audio response is influenced primarily by the mechanical parameters of the speaker.

If the shape of the upper portion of curve 30A is extended to lower frequencies as would occur for the resonance, as illustrated by the curve section 30B, the difference between 30A and 30B in this lower frequency range is a superimposed influence of the mechanical parameters upon the higher frequency resonance phenomena.

Because the goal is to design the components of the total compensation required, illustrated as curve 60A of FIG. 5, further quantitative analyses will relate to this reciprocal function.

Figure 6:
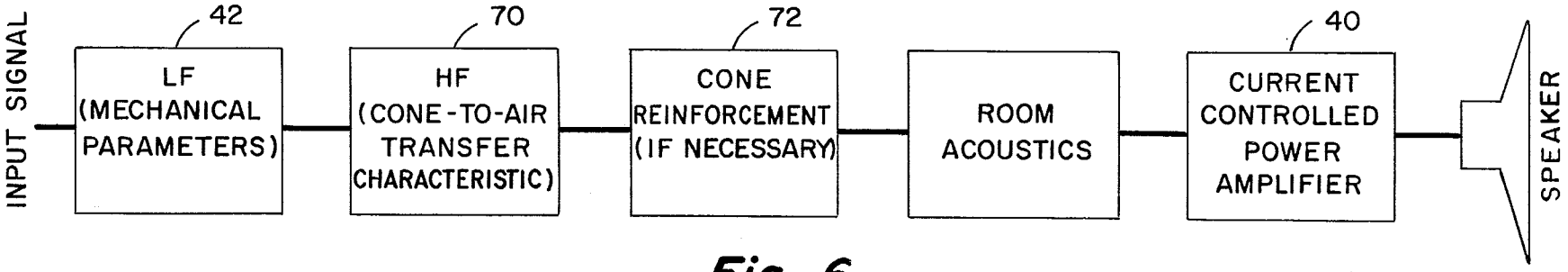
FIG. 6 is a functional block diagram of the compensation networks for a speaker according to the present invention.

A schematic plan for the connection of the component signal processing compensation sections is shown in FIG. 6. The order of their connection is unimportant because the final compensated signal applied to the power amplifier is the product of the primary input signal multiplied by the transfer characteristic of each of the signal processing components. For the present only the lower frequency (designated LF) and the higher frequency (designated HF) compensation networks 42 and 70 are being considered.

Figure 7:
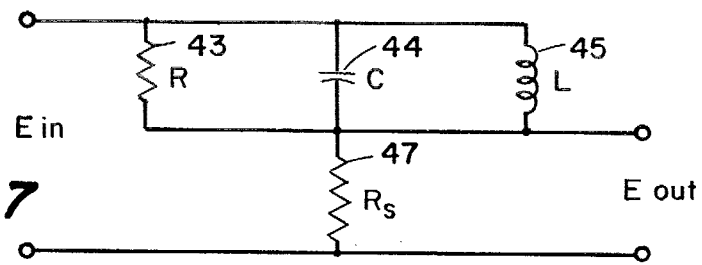
FIGS. 7 and 8 are circuit schematic diagrams for the various compensation networks of FIG. 6.

Because the type of compensation required for the characteristics 42 and 70 is the same on a qualitative basis, a network such as that shown in FIG. 7 can be employed for each.

One way to look at the operation of the system of FIG. 6 is to recognize that the input signal to the current amplifier is modified or "processed" by the insertion of the model or compensation networks 42 and 70 in such a manner that the frequency characteristics respectively are exactly the complements of the frequency sensitivity of the mechanical response characteristic of the speaker and the cone-air transfer characteristic. Hence, the network 42 compensates for the frequency sensitive characteristic of the mechanical response of the speaker represented by the excess of curve 30A over curve 30B of FIG. 4A, while network 70 compensates for the broad-band aspect of curve 30B up to about 200 Hz and curve 30A above 200 Hz.

The network form of FIG. 7, serving for compensation for both systems 42 and 70, permits the passage of more current for frequencies deviating from resonance in a manner exactly compensating for the reduced efficiency of the speaker in converting electrical power to acoustical power whether it be for the mechanical parameters or for the cone-air transfer characteristic. Again, due to the electrical modeling of the respective elements, the signal into power stage will be increased exactly in proportion to the amount needed in the speaker to produce a response that is not frequency sensitive.

Furthermore, by virtue of driving the speaker with a power amplifier whose output current is controlled, using current feedback in contrast to the more usual voltage feedback, the impedance of the transducer coil including the ohmic resistance $R_c$ and the self-inductance $L_c$, designated respectively 21 and 22 in FIG. 3, will not have a substantial distorting frequency effect. The high output impedance of the current amplifier 40 will force the desired current into any electrical circuit possessing any impedance value from zero impedance to the highest impedance within the power rating of the amplifier.

The amplifier 40 in the embodiment shown preferably has a high input impedance also so that it draws negligible current. The scaling of the parameters of the network 42 by the factor k may be used to bring the impedance of the network to a suitable level, depending upon the availability of model circuit parameters, and also considering the input impedance of the amplifier 40 and the output impedance of the voltage amplifier 50 as in FIG. 3. Buffer amplifiers may be needed between sections of FIG. 6 because the elements comprising networks of FIGS. 7 and 8 may possess impedance levels not sufficiently high to avoid loading the previous network.

Referring to the circuit of FIG. 7, the ratio of output to input voltage is:

$$\frac{E_{out}}{E_{in}} = \frac{R_s}{R_s + \left[\dfrac{1}{\dfrac{1}{R} + j(\omega C - \dfrac{1}{\omega L})}\right]} = \frac{R_s}{R_s + Z} \quad (1)$$

If $R_s$ is very small with respect to the minimum value of Z in the frequency range of interest, the ratio of output to input voltage is $R_s/Z$ whose minimum ratio is at resonance and is larger at all other frequencies. Variation of two of the three parameters comprising the resonant circuit will permit all required changes in (1) the resonant frequency and (2) the relative bandwidth of the output to input voltage ratio. If C and R are constant, then change in L results only in a shift of the resonant frequency; and if C and L are constant, change in R results in reshaping the slopes and breadth of the output to input voltage ratio over the frequency spectrum.

If $R_s$ is not negligibly small with respect to the minimum value of Z in the frequency range of interest, then a limiting action occurs upon the voltage ratio as the frequency deviates either way from resonance. Thus, $R_s$ comprises limiting means in the compensation network for either the mechanical parameters or for the cone-air transfer characteristics. This effect can be slight or extreme.

Consider now how two compensation systems of the form of FIG. 7 can be designed to match the dotted curve 60A of FIG. 5 which presumes no cone breakup. One of these systems will represent a modified compensation network or circuit for the cone-to-air transfer characteristic which will sometimes be called the higher frequency (HF) system; and the other will be a modified compensation circuit for the mechanical response parameters which will be called the lower frequency (LF) system.

It will be observed that the higher frequency range in FIG. 5 (above about 1.1 kHz) possesses the shape of a resonance curve having relatively small limiting effect. The minimum point on the dotted curve 60A is about 0.78 on the relative scale of compensation at about 1.1 kHz. At 5 kHz the ordinate is about 1.5. Limiting will be employed to a high degree on the LF system so that the LF system will have much more effect upon the composite below 1 kHz than above it. Assuming negligible limiting effect from $R_s$ in the HF system, the compensation provided by it will be proportional to $R_s/Z$, at least between 1 kHz and 5 kHz.

Assume that C is fixed at 0.005 microfarad in the HF system of FIG. 7. At resonance L is $1/(\omega^2 C)$. Assuming resonance for HF system is 1.1 kHz, then L is 5.066 H. At 5 kHz the impedance Z must be 1.5/0.78 or 1.92 times larger than at 1.1 kHz. Having C and L known, $Z^2$ is $$Z^2 = \frac{1}{\left(\dfrac{1}{R}\right)^2 + 0.0227 \times 10^{-6}} \quad (2)$$

At 1.1 kHz Z = R. The square of the ratio of the Z's must be $(1.92)^2$ or 3.7, so $$3.7 = \frac{\left(\dfrac{1}{R}\right)^2 + 0.0227 \times 10^{-6}}{\left(\dfrac{1}{R}\right)^2} \quad (3)$$

and the R that will match the compensation to the need at the two frequencies is R = 11 kΩ.

The image frequency on the low frequency side of resonance of the HF or cone-air transfer characteristic compensation system corresponding to 5 kHz on the high side of resonance is at $(1100)^2/(5000) = 240$ Hz. At this frequency the dotted curve 60A of FIG. 5 has an ordinate of about 1.45. This is essentially the same as the ordinate at 5 kHz so the curve 60A matches closely a true resonance curve at 240, 1100 and 5000 Hz with negligible limiting by $R_s$ in this range of frequencies.

Turning now to the LF or mechanical response parameter's modified compensation system, the cone resonance is 72 Hz so in order to match the low frequency region which has a sharp slope on each side of resonance the LF compensation system must have a resonant frequency at least close to 72 Hz. If limiting action is chosen in this LF system so as to be nearly complete at about 240 Hz, the maximum of the dotted curve 60A of FIG. 5, which occurs at about 120 Hz, can be determined by the LF compensation system including proper adjustment of its limiting action. The corresponding low frequency image of the 240 Hz on its high frequency side is $(72)^2/240$ or 22 Hz. Therefore, when limiting is essentially complete there will be no detrimental effect in the audible region. Some compromise may occur in the region where limiting action progresses to completion.

Choosing a value for C, matching the low frequency slope below 72 Hz to establish R and choosing a first tentative value for $R_s$ for the LF compensation is the next step. Depending upon the match desired, several trials may be necessary to achieve an approximate match to the dotted curve 60A of FIG. 5, which in itself is only an estimate until a first approximation for the cone breakup compensation is included. However, persons skilled in the art will readily determine these values.

CONE BREAKUP

To reinforce the signal in the region of 900 Hz to compensate for the loss of response due to cone breakup, reference is first made to FIG. 5. At a particular frequency, such as 800 Hz where reinforcement of the signal is needed, the dotted curve 60A (which presumes no cone breakup) has an ordinate of about 0.80 when read on a closely-scaled plot. The Bruel and Kjaer pink-noise data at 800 Hz is 2.60. Therefore a refinforcement of 2.60/0.8, or 3.3 is needed.

Plotting such information for 800 Hz and all other frequencies from 300 to 2000 Hz as obtained from FIG. 5 yields a curve denoted 60B in FIG. 5. When the data ratios are removed from the curving dotted base 60A of FIG. 5 and plotted on a horizontal abscissa scale the form is that of a resonance curve peaking above a base of unity between perceptible rises from about 200 Hz to about 4 kHz. These are approximately image frequencies with 900 Hz as a center.

The circuit configuration of FIG. 7 which has been employed in this present embodiment for compensation of mechanical response parameters and cone/air transfer has presumed that the signal processing section operates from a voltage controlled system, although other embodiments involving current controlled sources could be used, such as are described in said patent.

Figure 8:
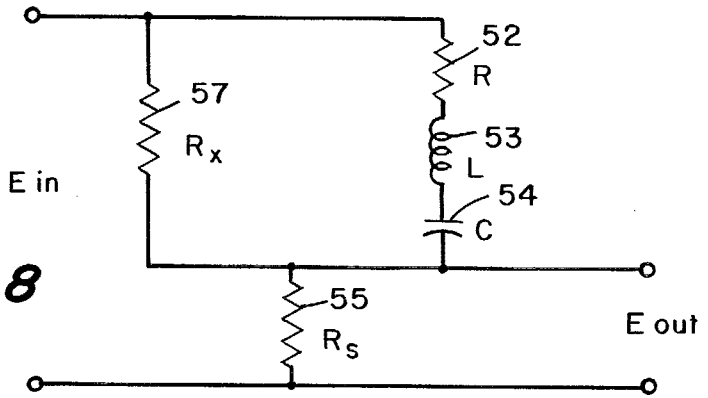

In the HF and LF compensation systems of the circuit of FIG. 7 provides minimum output signal at resonance. The system desired for compensation for the cone breakup loss is the inverse of this. At the resonant frequency of about 900 Hz the compensation signal should be maximum, hence, the series RLC circuit of FIG. 8 is suitable. In addition, a shunt resistor 57 in parallel with the series resonant circuit holds the output constant at frequencies remote from the resonant frequency. Thus, the circuit of FIG. 8 comprises compensation circuit means for signal reinforcement to overcome the effects of cone breakup for curve 60B as it approaches unity ordinate below 200 Hz and above about 4000 Hz.

The resistor 55 is again used for developing an output signal $E_{out}$. At resonance the output to input voltage ratio is $$\frac{E_{out}}{E_{in}} = \frac{R_s}{R_s + \frac{R\,R_x}{R + R_x}} \tag{4}$$

At frequencies relatively far removed from resonance, the output to input voltage ratio is $R_s/(R_s + R_x)$. Calling the ratio between these two gain equations the Peak/Base output ratio, it is defined as:

$$\frac{\text{Peak}}{\text{Base}}\ \text{output ratio} = \frac{R_s + R_x}{R_s + \frac{R\,R_x}{R + R_x}} = 1 + \frac{(R_x)^2}{R_sR_x + R\,R_s + R\,R_x} \tag{5}$$

If $R_x$ is small relative to the value of impedance of the series RLC circuit at particular frequencies, the peak will be correspondingly sharp. From Equation (5), it may be noted that the rise above the base is influenced by all three resistors. Assuming C is fixed in the system, a choice of L determines the resonant frequency. Then a combination of the three resistor values should be chosen to fit the cone breakup compensation circuit of FIG. 8 to supply the required function 60B of FIG. 5, taking into account the impedance level of the circuit with respect to its source of input voltage.

Following the principles of iteration disclosed in said patent, several iterations on choices of components in the LF design, some modifications in the HF, and with somewhat larger peak compensation for reinforcement for cone breakup were fitted together to yield an overall compensation for the coil current $I_c$. The subsets of this total compensation system are shown in FIG. 9.

Figure 9:
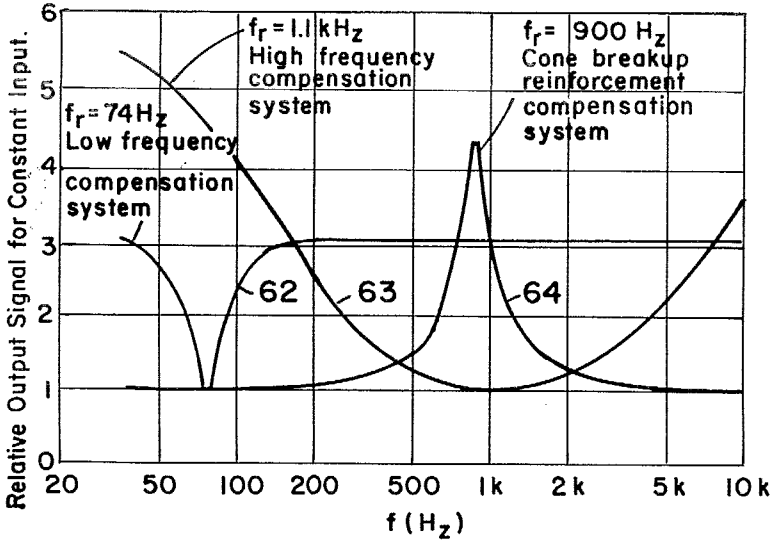
FIG. 9 is a graph of the relative output signal for constant input signal for the various compensation networks required to equalize the overall response for the system characteristic illustrated in FIG. 4A.

Turning then to FIG. 9, reference numeral 62 represents a gain curve for a network such as that shown in FIG. 7 which has been designed to compensate for the mechanical response parameters of the transducer (this is sometimes referred to as the low frequency compensation). Curve 63 is a similar curve, also for a compensation network of the type shown in FIG. 7 providing compensation for the air-cone interface (sometimes referred to as the high-frequency compensation system). Curve 64 is a gain curve for a network shown in FIG. 8 which has been designed to compensate for cone breakup--that is to provide a signal reinforcement for those frequencies at which cone breakup occurs.

The HF resonant frequency was held at 1.1 kHz as presumed for the first approximation. The LF resonant frequency was set at 74 Hz rather than at the measured cone resonance of 72 Hz in order to better match the rising curve on the high side of the LF resonance. Also, the maximum compensation region in the frequency range of 100 to 125 Hz was raised somewhat from the first approximation of curve 60A in this frequency range.

Figure 10:
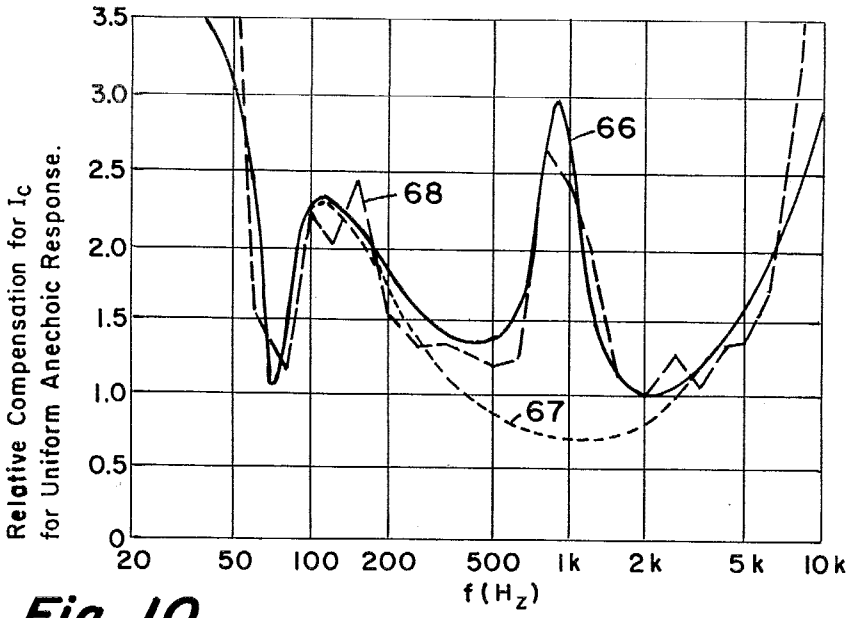
FIG. 10 is a graph of relative compensation for processing the coil current as a function of frequency to achieve uniform anechoic response in the speaker.
Figure 11:
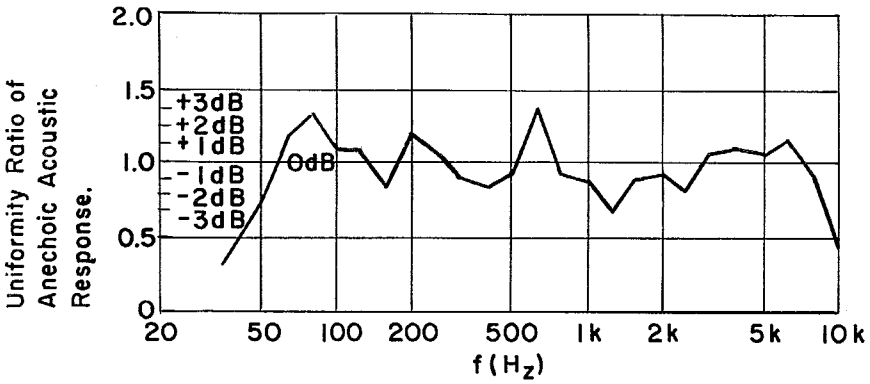
FIG. 11 is a graph of the uniformity ratio of anechoic acoustic response for the speaker after compensation.

The total compensation is shown in FIG. 10 as the solid curve 66. The pink-noise data are repeated here as curve 68 for comparison. The dotted curve 67 of FIG. 11 illustrates the compensation that would be provided if the cone breakup reinforcement were not needed. This dotted curve 67 is somewhat lower than the first approximation curve 60A in FIG. 5 for the region from about 400 to 3000 Hz.

A system was then assembled including three networks (refer to FIG. 6) inserted prior to the speaker 10 and the current controlled power amplifier 40. These included a first compensation network for compensating for the mechanical response parameters of the speaker (the LF network 42). Also in circuit was a network 70 for compensating for the cone-air transfer characteristic, and a network 72 for compensating for cone breakup. At this time, there was no compensation network for room acoustics, but the system as described was measured for its audio response in an anechoic environment with calibrated microphone and measured input signals. The measured anechoic acoustic response using pink-noise primary signals is very uniform except the extreme values at 40 Hz and 10 kHz as would be expected from FIG. 10. All data except readings at these two extreme frequencies were averaged and the resulting average level was used as the base for calculating a uniformity ratio including the ones for the frequency extremes. The results are shown in FIG. 11. On the ordinate ratio scale the corresponding dB scale values are also shown. Of the 25 total readings at ⅓-octave intervals, 39% were less than 1 dB deviation from the average, 78% were within a +2 dB deviation and 91% (all except the 40 Hz and the 10 kHz readings) were within a +3 dB deviation.

COMPENSATION FOR ROOM ACOUSTICS

Figure 12:
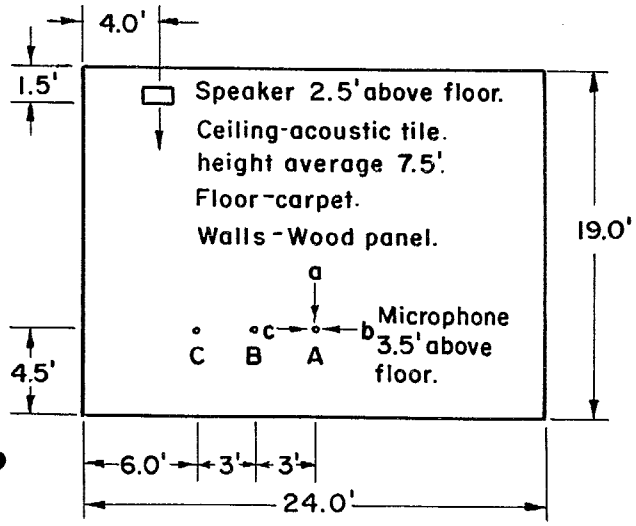
FIG. 12 is a diagrammatic illustration of how the measurement of FIG. 13 was taken.

The speaker was then placed in a room 24 ft. by 19 ft. and was located as shown in FIG. 12 as 4 ft. from a side wall and 1.5 ft. from a back wall. This location was chosen after study of an article "The Speaker and the Listener" by Allison in the August, 1976 *Stereo Review.* Microphone locations were chosen at three positions (A, B, and C) as shown in FIG. 12. Tests were made for three orientations of the microphone at each of the three locations. The microphone was a cardioid type pickup pattern. The three orientations were directed to receive maximum input from the *a, b,* and *c* directions as in FIG. 12.

The average of the resulting nine sets of readings were then obtained. The average of each set was then compared with the respective reading at the same frequency and with the same signal source of pink noise of the anechoic readings as in FIG. 11. The ratio of these comparisons are plotted in FIG. 13 as a curve 74 which defines a room acoustic gain factor. A smoothed estimate of these data is shown as curve 75. A number greater than unity indicates that the room (as determined from the nine readings in three locations) acts to increase the relative response at that particular frequency.

The general tendency of this particular room is that on the average it enhances frequencies most in the range of about 700 Hz. The maximum gain factor was a little more than 1.4. At about 60 Hz and also at 10 kHz the corresponding factor has a value of about 0.6.

Figure 13:
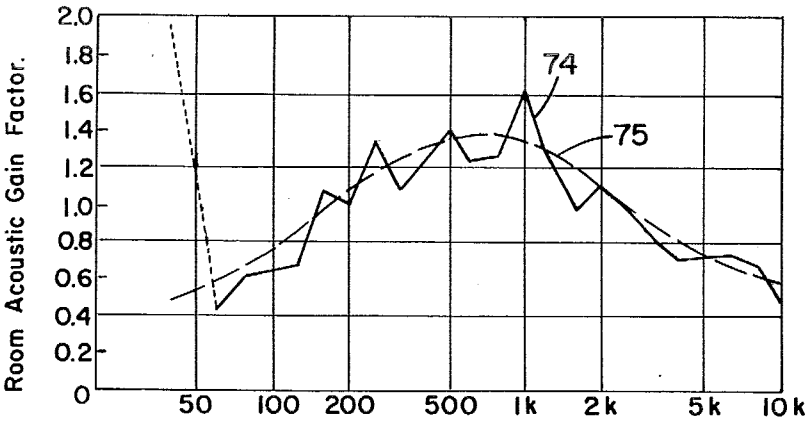
FIG. 13 is a graph of an acoustic gain factor for a given room as a function of frequency.

It will be observed that the shape of the function of FIG. 13 is of the form of a resonance curve. It is desirable that compensation for the room acoustics be provided with a compensation network of the type shown in FIG. 7 so that the average listener location will receive an audio response for the speaker and room combination which is as non-frequency sensitive as was the speaker alone with its anechoic balance.

The smoothed dotted curve 75 as shown in FIG. 13 is a guide in choosing a system for compensation. The very low frequency ratios are ignored because they come in ratios of decreasingly smaller numbers which in itself is not conductive to good accuracy. Further, the microphone calibration, which is for the microphone as a class, may not be completely accurate for each microphone, particularly at the frequency boundary where the microphone ceases to respond at all.

Figure 14:
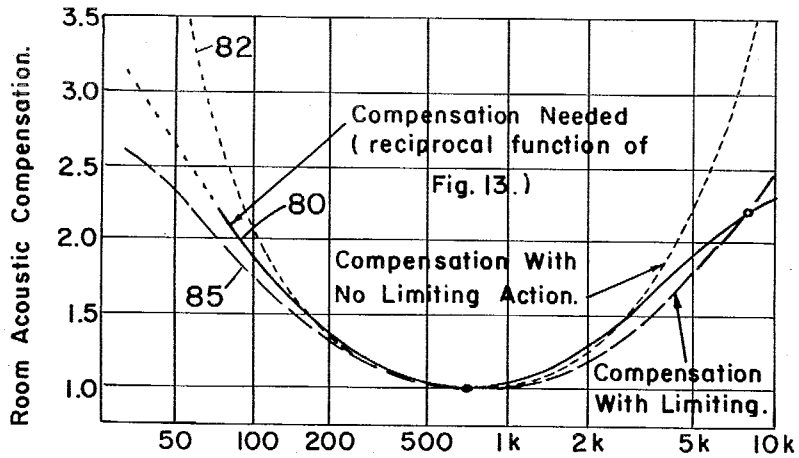
FIG. 14 is a series of graphs illustrating a compensation technique for the acoustics of the room of FIG. 12.

The reciprocals of the room acoustic gain factors as taken from the smooth curve of FIG. 13 are shown as the solid curve 80 in FIG. 14 as relative numbers with unity as the minimum. The section below about 80 Hz is shown as an array of dots to indicate the uncertainty of the exact ordinates in this region. Some limiting may fit naturally in the compensation plan at the higher and lower frequencies removed from resonance.

Picking an ordinate such as 1.5 below such limiting, one notes the upper frequency here is 3000 Hz and the lower is 152 Hz (on a closely scaled plot). The resonant frequency matching these points is $\sqrt{152 \times 3000} = 675$ Hz so this frequency may be used as the resonant frequency of the compensation network. For the circuit of FIG. 7, let C = 0.005 microfarads. For $f_r = 675$ the corresponding inductance is 11.12 H. For the impedance ratio of 1.5 above the minimum 1.0 and for the corresponding frequency ratio of 3000/675 (or 675/152) = 4.44 requires that the resistor R be 12.5 kΩ.

The plot of the room acoustic compensation network for R = 12.5 kΩ, C = 0.005 microfarads and L = 11.12 H is shown as the dotted curve 82 of FIG. 14. The match is reasonably good below the 1.5 ordinates but rises above the data curve for higher ordinates. This permits a determination of a resistor $R_s$ which is not negligible with respect to the values of Z at those higher and lower frequencies removed from resonance. Because the lower frequency compensation needs are not as accurately known, the upper frequency side will be used to determine $R_s$. The impedance Z of the parallel RLC network at 8 kHz is 3.8 kΩ and this point will be used to match an $R_s$ value which will provide the ordinate value of 2.25. Thus, the magnitude ratio of $(Z + R_s)/Z$ is to reduce the unlimited ordinate of 3.25 at 8 kHz to 2.25. The phasor form of Z at 8 kHz is $1.17 + j$ 3.64 KΩ so $R_s$ can be calculated as 6.4 kΩ.

Using this value of $R_s$ the resultant compensation is shown as the dashed curve 85 of FIG. 14. The effect of using this $R_s$ causes some reshaping of the curve below 8 kHz and in the low frequency ranges as well but the end result is still a reasonable match to the need as determined from the data of FIG. 13.

A microphone acts as an electro-acoustic transducer in converting acoustic sound pressure waves to electric signals. Microphones exhibit the same general form of response characteristic per unit of input as do electrical speakers.

The relative response curve for the microphone used for these experiments is shown in FIG. 15. This plot, to a linear scale ordinate with unity as its maximum sensitivity, is obtained from the decibel calibration data supplied by the manufacturer for this model.

The diaphragm mechanical parameter resonance is evident from the relatively small low frequency peak at about 220 Hz. The high frequency peak in the range of 5k to 8 kHz demonstrates the predominance of the air-diaphragm transfer characteristic over the influence of the mechanical parameters in the higher frequency range.

A slight diaphragm breakup occurs at about 6 kHz. Compensation could be made for it as was done with the speaker but will be neglected here because the effect is relatively small.

Curve 90 of FIG. 16 is the reciprocal of FIG. 15. Fitting a compensation system of the form of FIG. 7 with the HF system with a resonant frequency of about 5 kHz and the LF system with a resonant frequency of about 220 Hz yields after several iterations two designs illustrated as curve 92 and 91, respectively. As with the speaker compensation the HF system requires a relatively low degree of limiting whereas the LF system, although broader band than for the speaker, is still completely limited in the higher audio frequency range.

The degree with which these two compensation systems satisfy the required effect is shown in the three regions of variance by the small sections of curves marked 90A, 90B and 90C.

The compensation, being electrical, must be connected on the output side of the transducer. Because electrical loads placed on the output of microphones can be of relatively high impedance no need exists for a power amplifier as was needed in the speaker system, but a buffer amplifier should be placed after the compensation network of FIG. 7 if the input impedance of the external connection is not very high with respect to the compensation network.

Having thus described in detail a preferred embodiment of the invention, persons skilled in the art will be able to modify certain of the structure which has been illustrated and to substitute equivalent elements for those disclosed while continuing to practice the principle of the invention; and it is, therefore, intended that all such modifications and substitutions be covered as they are embraced within the spirit and scope of the appended claims.

I claim:

1. A system for compensation for frequency dependent characteristics of an electro-acoustical transducer having a movable cone and associated mechanical response parameters and driven by current amplifier circuit means, comprising:

first compensation circuit means in circuit with said amplifier circuit means for processing an input audio signal to compensate said signal for the mechanical response parameters of said transducer in the region of resonance of said mechanical response parameters; and second compensation circuit means in circuit with said amplifier circuit means and said first compensation circuit means for processing said audio signal to compensate said signal for the cone-air transfer characteristic of said transducer;

the compensated signal of said first and second compensation circuit means being coupled to said amplifier circuit means.

2. The system of claim 1 further comprising third compensation circuit means in circuit with said first and second compensation circuit means and with said amplifier circuit means for processing said audio signal to compensate said signal for the cone breakup characteristic of said transducer.

3. The system of claim 1 wherein said first compensation circuit means further includes limiting circuit means for limiting the effect of said first compensation circuit means outside the region of resonance of said mechanical response parameters.

4. The apparatus of claim 3 wherein said first compensation circuit means includes a parallel resonant circuit in series with a signal resistor, said signal resistor being larger in value than the magnitude of the impedance of said parallel resonant circuit outside the region of resonance of said mechanical response parameters of said transducer.

5. The system of claim 1 wherein the cone-air transfer characteristic of said transducer has a resonance effect and wherein said second compensation circuit means comprises a parallel resonance circuit in series with a signal resistor, the magnitude of said signal resistor being small in relation to the magnitude of the impedance of said parallel circuit outside the resonance region of said cone-air transfer characteristic.

6. The apparatus of claim 2 wherein the cone breakup characteristic of said transducer exhibits resonance and wherein said third compensation circuit means comprises circuit means for reinforcing said input signal in the region of cone breakup resonance.

7. The system of claim 6 wherein said third compensation circuit means comprises a series resonance circuit in series circuit with a signal resistor, the resonant frequency of said series resonance circuit being selected to compensate for the resonance of cone breakup.

8. The apparatus of claim 7 further comprising a shunt resistor across said series resonance circuit of said third compensation circuit means for limiting the compensation effect thereof outside the region of resonance for cone breakup.

9. The system of claim 1 further comprising fourth compensation circuit means in circuit with said amplifier circuit means and said first and second compensation circuit means for compensating for the acoustical characteristics of a room in which said system is located, said acoustical room characteristic defining on the average a resonance effect, said fourth compensation circuit means comprising resonance circuit means having a resonant frequency at approximately the same frequency as the resonance of said room.

10. The system of claim 9 wherein said fourth compensation circuit means further comprises means for limiting the effect thereof outside the region of resonance.

11. A method for compensating for the mechanical response parameters, cone-air transfer characteristic and cone breakup characteristic of an electro-acoustical transducer having a cone and mechanical response parameters, comprising: measuring the anechoic acoustic response of said transducer while driving said transducer with a constant coil current over a predetermined frequency range; connecting a first compensation circuit means having a resonant frequency corresponding to the measured resonance of said mechanical response parameters in circuit with said transducer, said first compensation circuit means having limited effect outside of the region of resonance of said mechanical response parameters; connecting a second compensation circuit means in circuit with said transducer, said second compensation circuit means having a resonance corresponding to the resonance of said cone-air transfer characteristic; and connecting a third compensation circuit means in circuit with said transducer, said third compensation circuit means having a resonance corresponding to the resonance of cone breakup and reinforcing the signal to said transducer in the region surrounding said cone breakup resonant frequency.

12. The method of claim 11 wherein said step of measuring comprises energizing said transducer with a source of bandlimited random-frequency signals.

13. A method for compensating for the acoustical characteristics of a room exhibiting a resonance effect comprising placing a speaker in said room at a predetermined location, placing a microphone in said room at a first predetermined location, energizing said speaker with a source of pink noise over a predetermined frequency range, measuring the response at said microphone for a plurality of locations and for a plurality of orientations, averaging said response characteristics over said frequency range and accounting for the pink noise characteristics of said source to generate a resonance acoustical characteristic for said room, connecting a resonant compensation circuit in series with said speaker, said compensation circuit having the resonance frequency corresponding to the resonance frequency of said measured acoustical characteristic for said room.

14. The method of claim 13 further comprising the step of limiting the compensation of said compensation circuit means at the low and high frequency regions of said predetermined frequency range.

15. A method for compensating for the mechanical parameter resonance and the air-diaphragm transfer characteristic of a microphone having a diaphragm and mechanical response parameters comprising: defining the electrical response of said microphone for a constant amplitude of sound pressure level input over a frequency range; connecting a first compensation circuit means in circuit with said microphone, said first compensation circuit means having a resonant frequency corresponding to the mechanical parameter resonance of said microphone; and connecting a second compensation circuit means in circuit with said microphone and said first compensation circuit means, said second compensation circuit means having a resonance corresponding to the resonance of said air-diaphragm transfer characteristic of said microphone.

16. The method of claim 15 further comprising the steps of defining a diaphragm break-up resonance characteristic of said microphone within said frequency range; and connecting a third compensation circuit means in circuit with said microphone and said first and second compensation circuit means, said third compensation circuit means having a resonance corresponding to the resonance of said diaphragm break-up characteristic.

17. Apparatus for compensating for the mechanical parameter resonance and the air-diaphragm transfer characteristic of a microphone having a diaphragm and mechanical response parameters comprising: first compensation circuit means in circuit with said microphone, said first compensation circuit means having a resonant frequency corresponding to the mechanical parameter resonance of said microphone; and second compensation circuit means in circuit with said microphone and said first compensation circuit means, said second compensation circuit means having a resonance corresponding to the resonance of said air-diaphragm transfer characteristic of said microphone.

* * * * *